US007621288B2

(12) United States Patent
Evans

(10) Patent No.: US 7,621,288 B2
(45) Date of Patent: Nov. 24, 2009

(54) HAND BASED WEIGHT DISTRIBUTION SYSTEM

(76) Inventor: Jeffrey D. Evans, 13909 E. 29th Ct., Veradale, WA (US) 99037

( * ) Notice: Subject to any disclaimer, the term of this patent is extended or adjusted under 35 U.S.C. 154(b) by 0 days.

(21) Appl. No.: 10/253,214

(22) Filed: Sep. 23, 2002

(65) Prior Publication Data

US 2004/0055629 A1 Mar. 25, 2004

(51) Int. Cl.
*A45B 9/02* (2006.01)
*A61H 3/02* (2006.01)

(52) U.S. Cl. ..... 135/76; 135/68; 135/72

(58) Field of Classification Search ..... 135/65, 135/67, 68, 71, 72, 73, 66, 76; 280/819, 280/821

See application file for complete search history.

(56) References Cited

U.S. PATENT DOCUMENTS

| | | | | | |
|---|---|---|---|---|---|
| 572,989 | A | | 12/1896 | Heinecke | |
| 875,482 | A | | 12/1907 | Wyatt | |
| 1,120,305 | A | | 12/1914 | Graves | |
| 1,296,728 | A | * | 3/1919 | Yates | 135/72 |
| 1,463,675 | A | * | 7/1923 | Coleman | 135/68 |
| 1,769,167 | A | | 7/1930 | Scheihing | |
| 2,388,374 | A | * | 11/1945 | Tracy | 135/72 |
| 2,585,730 | A | | 2/1952 | Bodnar | |
| 2,678,054 | A | | 5/1954 | Bostelman | |
| 2,778,370 | A | * | 1/1957 | Chamblee | 135/68 |
| 3,174,494 | A | | 3/1965 | Maguire, Jr. | |
| 3,205,905 | A | | 9/1965 | Gottman | |
| 3,213,870 | A | | 10/1965 | Kiehn | |
| 3,272,210 | A | | 9/1966 | Boruvka | |
| 3,289,685 | A | * | 12/1966 | Parker | 135/65 |
| 3,565,451 | A | * | 2/1971 | Giambazi et al. | 280/821 |
| 3,999,565 | A | | 12/1976 | Delacour et al. | |
| 4,141,375 | A | * | 2/1979 | Tykwinski | 135/66 |
| 4,237,915 | A | * | 12/1980 | Zabielski et al. | 135/68 |
| 4,245,659 | A | | 1/1981 | Shofner | |
| D258,096 | S | | 2/1981 | Barfod | |
| 4,451,080 | A | * | 5/1984 | Nix | 297/4 |
| 4,572,545 | A | * | 2/1986 | Dooley et al. | 280/821 |
| 4,711,261 | A | * | 12/1987 | Rosenberg | 135/72 |
| 4,730,632 | A | * | 3/1988 | Mace | 135/76 |
| 4,793,370 | A | | 12/1988 | Perez et al. | |
| 4,809,725 | A | * | 3/1989 | Champigny | 135/75 |
| 4,996,978 | A | | 3/1991 | Gingras | |
| 5,178,595 | A | | 1/1993 | MacGregor | |
| 5,300,016 | A | | 4/1994 | Marlatt | |
| 5,329,954 | A | | 7/1994 | Miyoshi | |
| 5,348,035 | A | | 9/1994 | Porter | |

(Continued)

FOREIGN PATENT DOCUMENTS

| | | |
|---|---|---|
| FR | 1.101.212 | 10/1955 |

(Continued)

*Primary Examiner*—David Dunn
*Assistant Examiner*—Danielle Jackson

(57) ABSTRACT

A hand based weight distribution system which utilizes a knuckle support platform and knuckle support surface to allow the user to place his or her knuckles on said surface, preferably concurrently grasping a handle and thereby support part or all of the weight of the user without placing undue pressure on the hand of the user or the handle of the body support apparatus. Included are a knuckle support platform, knuckle support surface, support structure with a first end disposed to engage the ground.

20 Claims, 6 Drawing Sheets

U.S. PATENT DOCUMENTS

| | | | | | |
|---|---|---|---|---|---|
| 5,458,143 | A | | 10/1995 | Herr | |
| 5,495,867 | A | * | 3/1996 | Block | 135/65 |
| 5,526,836 | A | * | 6/1996 | Sigsworth | 135/66 |
| 5,555,904 | A | | 9/1996 | Stockwell | |
| 5,564,451 | A | | 10/1996 | Hagberg | |
| 5,573,025 | A | * | 11/1996 | Atlas | 135/65 |
| 5,575,299 | A | | 11/1996 | Bieri | |
| 5,624,362 | A | | 4/1997 | Wilson | |
| 5,671,765 | A | | 9/1997 | Hagberg, Jr. | |
| 5,711,334 | A | * | 1/1998 | Roux | 135/65 |
| D394,148 | S | | 5/1998 | Hosick | |
| 5,746,236 | A | | 5/1998 | Tilsley et al. | |
| 5,755,644 | A | | 5/1998 | Breems | |
| 5,771,910 | A | | 6/1998 | Kluttz | |
| 5,860,439 | A | | 1/1999 | Ostertag | |
| 5,904,167 | A | | 5/1999 | Moye | |
| 5,911,234 | A | | 6/1999 | Hirst | |
| 5,924,434 | A | | 7/1999 | Cato, III | |
| 5,941,263 | A | | 8/1999 | Bierman | |
| 5,983,912 | A | * | 11/1999 | Leu | 135/66 |
| 6,154,882 | A | * | 12/2000 | Ullman | 2/20 |

FOREIGN PATENT DOCUMENTS

| | | | | | |
|---|---|---|---|---|---|
| FR | 1.112.170 | | 3/1956 | | |
| GB | 140171 | | 3/1920 | | 135/41 |
| GB | 1135612 | | 12/1968 | | |
| GB | 1135612 | A | * 12/1968 | | |
| SE | 118989 | | 6/1947 | | 135/68 |
| WO | WO 94/06393 | | 3/1994 | | 135/71 |

* cited by examiner

HAND BASED WEIGHT DISTRIBUTION SYSTEM

CROSS REFERENCE TO RELATED APPLICATION

This application does not claim priority from any other application.

TECHNICAL FIELD

This invention relates to a hand based weight distribution system, which may be utilized with crutches, canes, and other human support or assistance devices.

BACKGROUND OF THE INVENTION

Crutches, canes and other human support or human assistance apparatuses have been used for many years. It has been recognized by users and others that the placement of weight on the apparatuses can cause discomfort and/or other related problems with the user. For instance, a person on crutches typically develops sore hands or the palms of their hands from placing excess weight on the handle portion of the crutch, especially when the person is not accustomed to placing his weight on the crutch. The placement of too much weight on the hands over a period of time can also cause injury to the person's hand and/or wrist and worsen other pre-existing conditions such as arthritis, carpal-tunnel syndrome, etc.

A person using a crutch and placing too much weight on the underarm cushion or support can cause soreness and injury to the underarm of the person.

Further, there are certain people who have problems with their hands, such as carpal tunnel syndrome, who have great difficulty in using canes and using crutches because of the excess pressure placed on their hands. People with these other disorders are therefore much less mobile than they otherwise would be due to the current state of the art of hand based weight distribution systems and their inability to use the devices for extended periods of time.

It has been found by the inventor that redistributing the weight from the human body from either the armpits or from the palm of the hand on the handle to the knuckles and the forearm has beneficial and improved effects on the user of the body support apparatus. The redistribution of the weight forces through the knuckles and to and/or through the forearm increases the comfort and decreases some of the problems associated with the placement of the weight of the user's body on the palms of the hand and/or in the armpits.

It is therefore an object of this invention to provide an improved hand or arm based weight distribution system, or body support apparatus.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
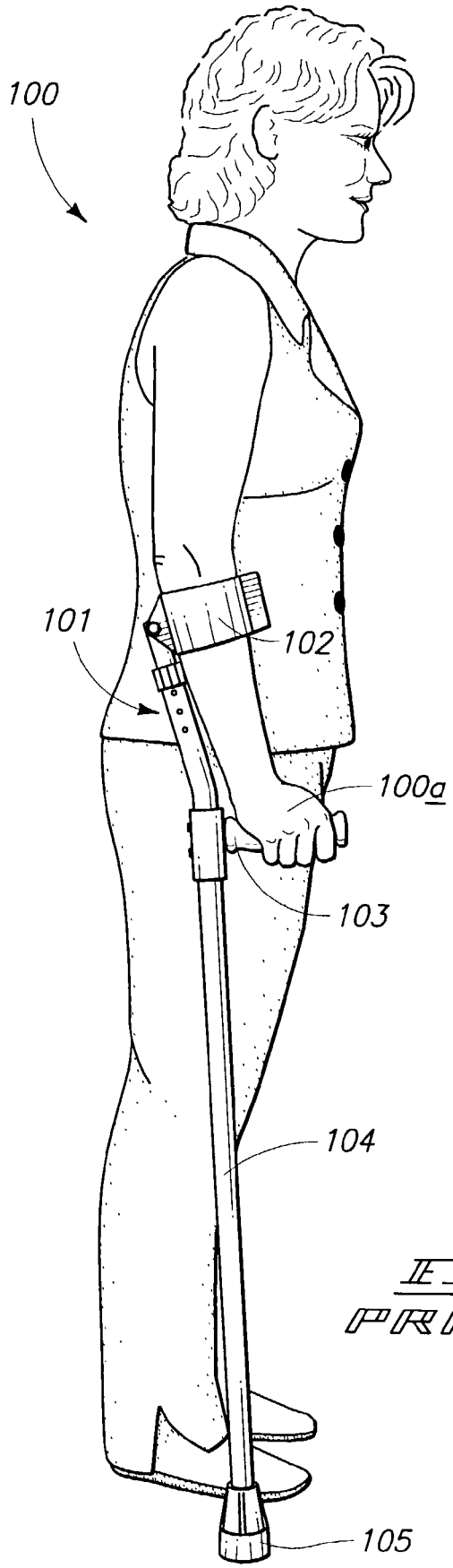
Fig 1 PRIOR ART
FIG. 1 is a side view of a user of a prior art crutch or cane in one of several typical configurations.

FIG. 1 is a side elevation view of a user with a prior art crutch, cane or other body support apparatus which includes a hand based weight distribution system thereon. FIG. 1 illustrates a user 100, a prior art weight distribution system 101 with forearm clamp 102, user's hand 100*a*, handle 103, support member or structure 104 with a first end 105 disposed to engage the ground.

Typically the forearm clamp 102 is used to help control the body support apparatus and not for the distribution of weight. In the prior art body support apparatus shown in FIG. 1, the weight from the user is all generally through the palm of the hand 100*a* of the user on the handle 103.

Figure 2:
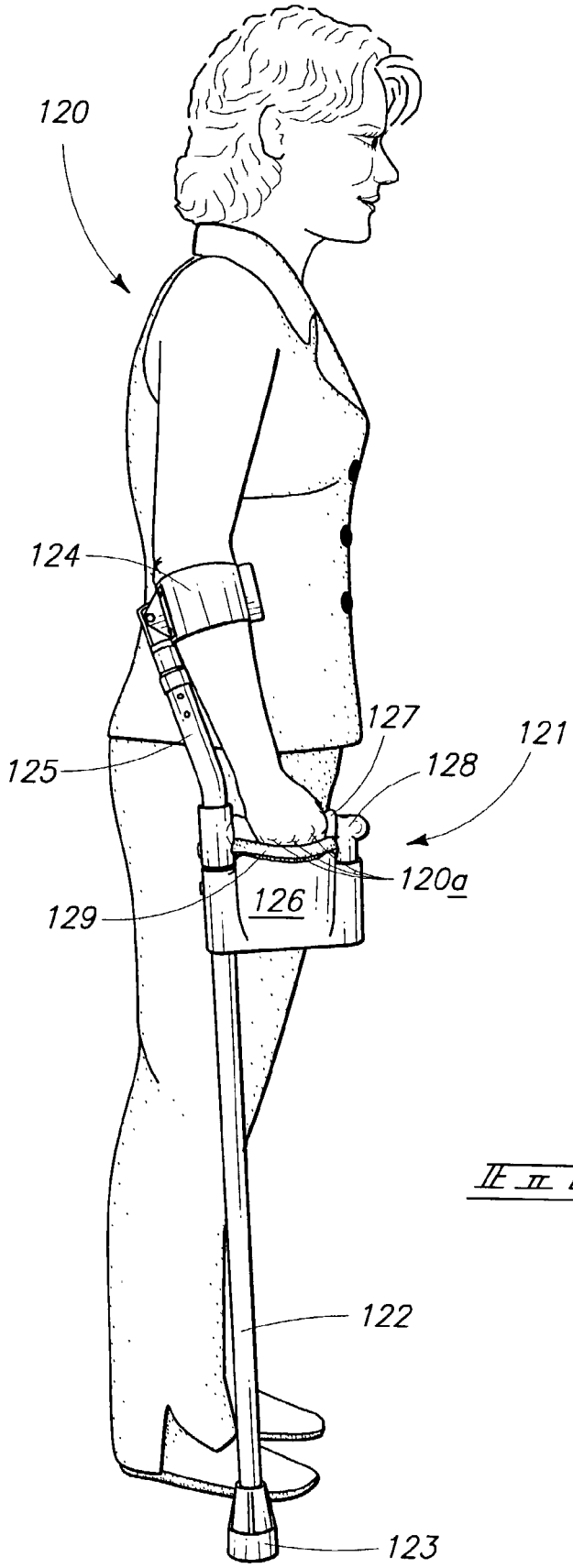
FIG. 2 is also a side perspective view of a user of one embodiment of this invention, a body support apparatus or hand based weight distribution system.

FIG. 2 is a side elevation view of an embodiment of this invention showing a user engaged therewith. FIG. 2 illustrates a user 120, a hand based weight distribution system for body support apparatus 121 with forearm clamp 124, support structure 122 with first end 123 disposed to engage the ground. The body support apparatus 121 includes knuckle support structure or platform 126 with knuckle support cushion 129 to support the user's knuckles 120*a*. Handle 127 is provided with handle cushion 128. The handle in FIG. 2 is illustrated in the downward position with the user's knuckles 120*a* pressed against the knuckle cushion 129.

Figure 3:
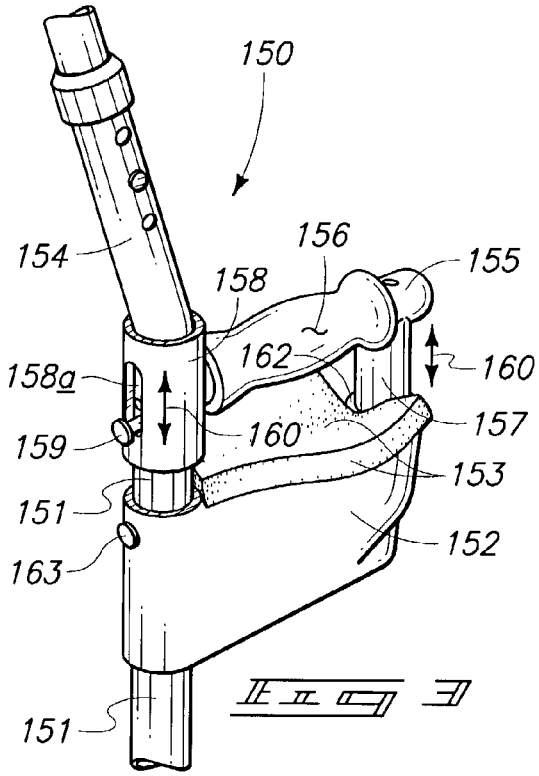
FIG. 3 is a perspective view of one embodiment of a body support apparatus contemplated by this invention, with the handle in the upward position.

FIG. 3 is a perspective view of an embodiment of this invention which better distributes the body weight of a user, namely through the user's knuckles and forearm instead of through the palm of the hand. FIG. 3 illustrates structure member 151, knuckle support platform 152 secured to structure member 151 via pin 163. Although not necessary to practice this invention, knuckle cushion 153 is placed on the knuckle support surface (under knuckle cushion 153) to provide additional cushioning and cushion for the user's knuckles as the weight of the user is placed on the knuckle support. The knuckle support platform 152 is mounted to structure member 151 via a collar configuration which is integral in the knuckle support platform 152 shown in this embodiment of the invention. Although an integral collar is utilized in this embodiment, any one of a number of different ways of mounting the knuckle support platform 152 to the structure member 151 is contemplated by this invention, with the invention not being limited to any one in particular.

The body support apparatus in FIG. 3 also illustrates an upper support 154 to which an armpit or a forearm support or attachment may also be attached.

FIG. 3 also illustrates handle 155 with handle cushion 156 moveably mounted relative to the knuckle support platform 152. Arrow 160 illustrates the movement and in the embodiment shown in FIG. 3, collar 158 is moveably mounted around support member 151 with stop pin 159 mounted in structure member 151 to control the movement via collar aperture 158*a*. Handle column 157 in the embodiment shown in FIG. 3 is mounted within a collar 162 within knuckle support platform 152 to control the upward and downward movement of handle 155. FIG. 3 illustrates the embodiment of the invention wherein the handle 155 is in the upward position.

Figure 4:
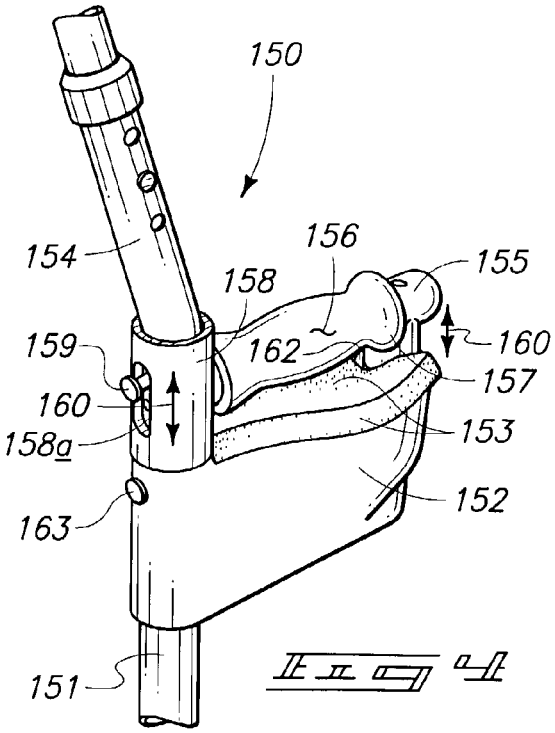
FIG. 4 is a perspective view of the embodiment of this invention illustrated in FIG. 3, only with the handle apparatus in a downward position.

FIG. 4 is the same perspective view as FIG. 3, with all the like numbers referencing the same components, and they will not therefore be described in detail again. FIG. 4 illustrates the embodiment of the invention illustrated in FIG. 3 wherein the handle 155 is in a downward position.

Figure 5:
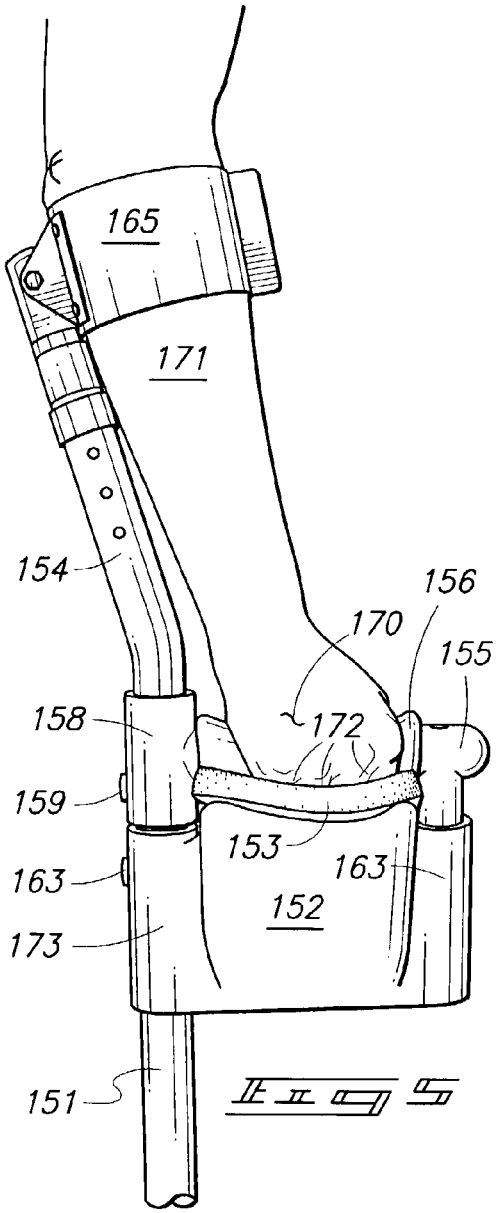
FIG. 5 is a side elevation view of the embodiment of this invention illustrated in FIG. 3, with a user's hand therein.

FIG. 5 is a side elevation view of the embodiment of the invention illustrates in FIGS. 3 and 4, with a user's arm 171 and hand 170 therein. FIG. 5 illustrates support member 151, upper support member 154 with forearm clamp 165 mounted thereto. The user's forearm 171 is within forearm clamp 165, and the user's hand 170 with user's knuckles 172 are placed in the invention. The knuckles 172 are pressed against or forced downward onto knuckle support platform cushion 153, and the hand of the user 170 is surrounding and gripped around handle 155 via handle cushion 156.

FIG. 5 also illustrates knuckle support platform 152 with collar 163 to receive handle 155 and collar 173 to receive support structure 151, with support pin 163 also shown.

The handle 155 with handle cushion 156 is shown in the downward position with the user's hand 170 placed thereon. The handle 155 in this embodiment of the invention is shown mounted to support member 151 via collar 158 and movement pin 159 which protrudes through the collar aperture 158*a* (not shown in this figure, but shown in FIGS. 3 and 4).

Figure 6:
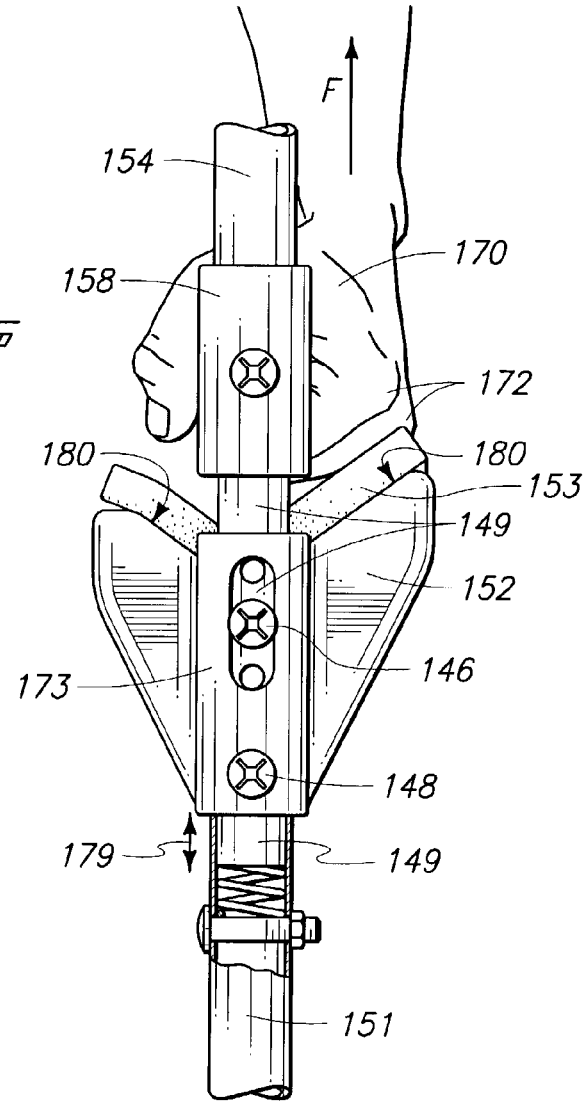
FIG. 6 is a front elevation view of the embodiment of this invention similar to that shown in FIG. 5, with the user's hand and knuckles positioned in the body support system, only wherein the handle is fixedly mounted and the knuckle support moves relative to the handle instead of the handle moving as in other embodiments.

FIG. 6 illustrates an example of the distribution of force through the forearm of the user, illustrating arrow F for the redistribution of force from the palm of the hand 170 of the user through the wrist and to and/or through the forearm of the user. The user's knuckles 172 are engaging knuckle cushion 153, and knuckle cushion 153 is mounted on knuckle support platform 152 for the comfort of the user's hand 170.

FIG. 6 shows another embodiment of how relative movement may be achieved between the handle and the knuckle support platform 152. Upper support member 154 provides a fixed mount for collar 158 of the handle, thereby fixedly mounting the handle to the upper support member 154. Middle support member 149 is smaller in diameter to upper support member 154 and is attached thereto. Middle support member 149 is slideable mounted within lower support member 151, with a stop screw and a spring shown therein to provide an upward bias on the middle support member 149, and consequently on the handle. FIG. 6 illustrates that the weight of the user is supported through the metacarpal area of the user's hand or knuckles. It is generally known and appreciated by those of ordinary skill in the art that the area of the knuckles shown in contact with the knuckle support surface in FIG. 6 includes the metacarpal area of the hand or knuckles.

The knuckle support platform 152 is fixedly mounted on lower structure member 151 via collar 173 and screw 148, while screw 146 is attached to middle support member 149, and gives a range of motion for middle support member 149 (and the handle) relative to lower support member 151. In prior figures, collar 158 for the handle is moveably mounted on structure member 151. Therefore in the embodiment shown in FIG. 6, the handle is shown fixedly mounted, and the knuckle support platform 152 is shown movably mounted such that it moves toward the user's knuckles 172 when pressure is applied downward by the user on the handle.

The movement of the handle on any of the embodiments is not necessary to practice the invention, but it is preferred because it allows the user to better control the cane, crutch or other device by having a handle, but the movement upward allows the user to remove his or her hand from the device when desired. It will be appreciated by those of ordinary skill in the art that the handle may be fixed or moveable, and the handle may also move in different directions.

In the embodiment shown in FIG. 4 for example, the handle is moving solely in the vertical direction, but the handle may also be mounted such that it pivots or moves partially in the vertical direction and partially in the horizontal direction, with no one in particular being required to practice this invention.

It will also be appreciated and should be noted that embodiments of this invention do not require a handle. Instead, embodiments of this invention may include a mitten-like cloth configuration where no handle is used and the user merely inserts his hand into the cloth guide or mitten configuration to engage the user's knuckles with the knuckle support platform. The use of a glove or other device then eliminates the need for a handle but still locates the user's knuckles on the knuckle support platform and still provides the user with a mechanism to control and move the body support apparatus (such as lifting and other movement during walking or use).

Figure 7:
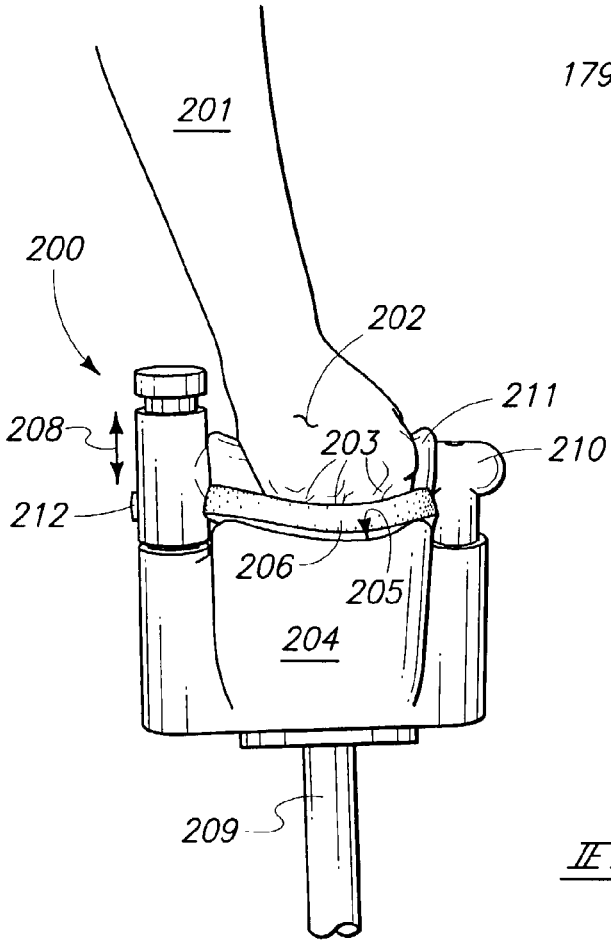
FIG. 7 is a side elevation view of a cane embodiment contemplated by this invention wherein the structure member is mounted below the knuckle support surface and generally centered below said surface.

FIG. 7 may be a cane embodiment of a body support apparatus contemplated by this invention, showing a user's forearm 201, user's hand 202, user's knuckles 203 engaged within the body support apparatus 200. FIG. 7 illustrates handle 210, handle cushion 211, knuckle support surface 205 with knuckle support surface cushion 206 mounted thereon, knuckle support platform 204 mounted on structure member 209. It should be noted that the structure member in this embodiment is generally centered under knuckle support platform 204. It will also be appreciated by those of ordinary skill in the art that the structure member 209 may be attached to a second structure, such as a ski, wheelchair, or any other in which part or all of the body weight of the user is desired to be supported by a knuckle support platform.

It should also be noted that there is no particular location, way or configuration for mounting knuckle support platform 204 relative to structure member 209. FIG. 7 also illustrates arrow 208 which shows the movement of handle 210 relative to knuckle support platform 204, in a similar fashion to that shown in figures illustrating other embodiments of the invention. While the term handle 210 is used throughout this application, the handle 210 may also be considered a finger retention surface which may be provided in any one of a number of different ways, such as by a flexible strap mounted relative to the knuckle support surface, or by a mitten or glove configuration mounted to or relative to the knuckle support surface such that the user may insert his or her fingers into the aperture defined thereby to allow control of the device.

Figure 8:
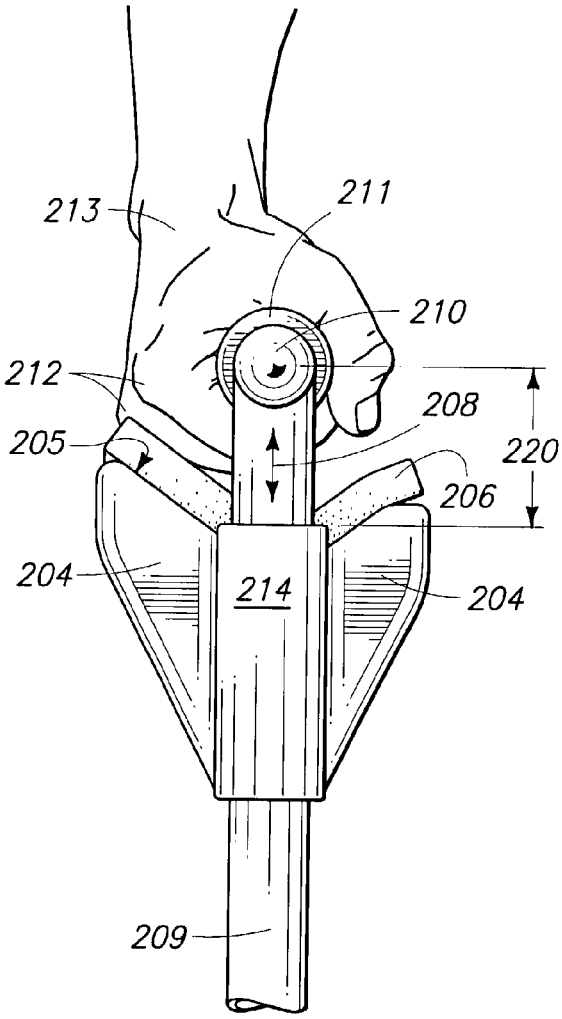
FIG. 8 is a front elevation view of the cane embodiment of the invention illustrated in FIG. 7 with the hand of a user around the handle and with the handle in the upright position.

FIG. 8 shows a front elevation view of an embodiment of this invention which may be utilized as a cane or other similar device. FIG. 8 illustrates structure member 209 with knuckle support platform 204 mounted thereon via collar 214, in a similar manner to the mounting of other embodiments shown in prior figures. Arrow 208 indicates that handle 210 is moveably mounted relative to knuckle support platform 204. FIG. 8 illustrates handle cushion 211, knuckle support platform cushion 206, knuckle support surface 205 on knuckle support platform 205, user's knuckles 212 on user's hand 213 and a distance 220 of the centerline of the handle 210 to the top of the collar 214.

Figure 9:
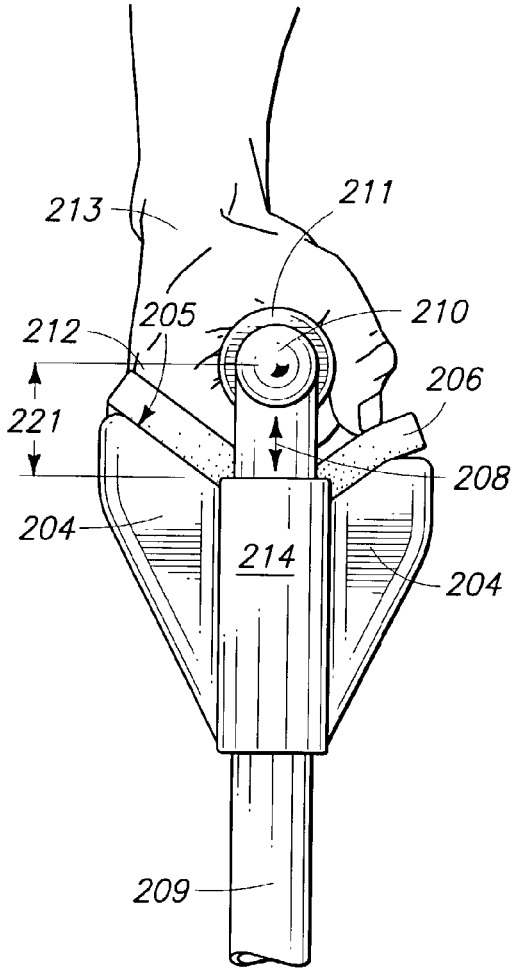
FIG. 9 is a front elevation view of the cane embodiment of the invention illustrated in FIG. 8, only with the handle in a downward position.

FIG. 9 is also a front elevation view of the embodiment of the invention illustrated in FIG. 8, only wherein the handle 210 is in a more downward position than shown in FIG. 8, with the distance 221 from the centerline of the handle 210 to the top of the collar 214 being different than distance 220. The item numbers and references in FIG. 9 are the same as for FIG. 8 and will not therefore be repeated herein.

Figure 10:
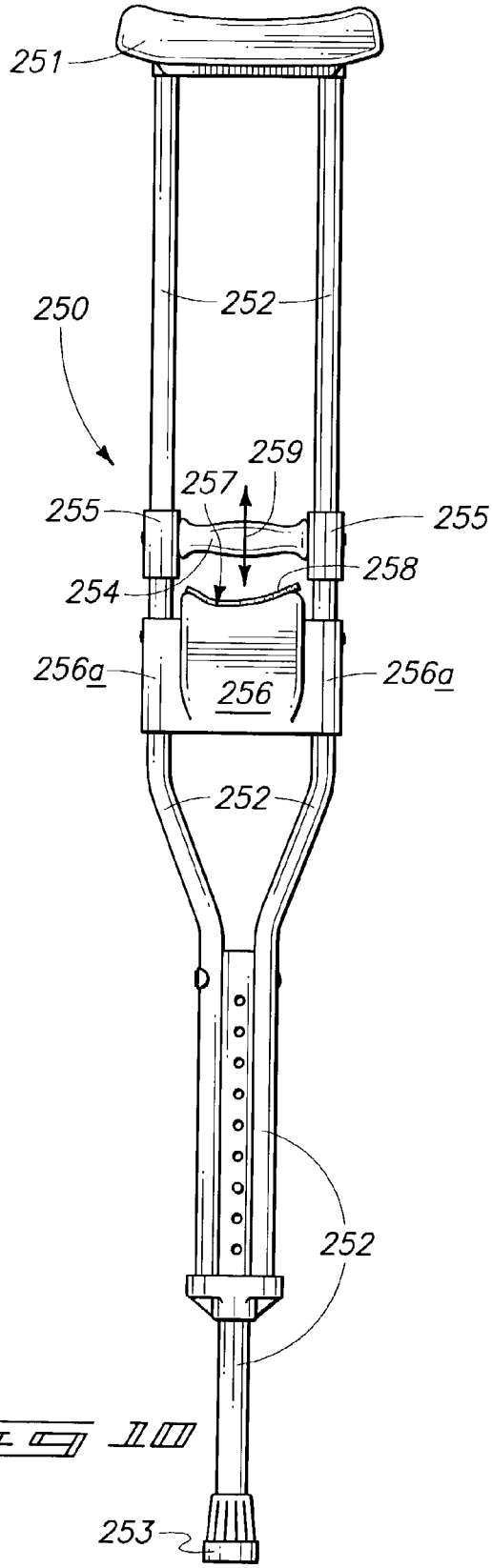
FIG. 10 is a side elevation view of a typical crutch, only with an embodiment of the invention utilized thereon.

FIG. 10 is a side elevation view of a typical crutch structure member, only with an embodiment of the invention mounted thereon in place of a normal prior art handle. FIG. 10 illustrates structure member 252 with underarm or armpit support 251 mounted thereon, and a first end of the structure member 253 disposed to engage the ground when the apparatus is utilized by a user.

FIG. 10 illustrates knuckle support platform 256 mounted on structure member columns 252 via collars **256*a*, which are shown integral with knuckle support platform 256. It will be noted that the collars need not be integral with knuckle support platform 256, and there are numerous other ways which may be utilized to mount knuckle support platform 256 to structure member 252**.

FIG. 10 further illustrates a handle 254 moveably mounted on structure member 252 via collars 255 which are integral with handle 254. The invention also includes a knuckle support surface 257 which is part of knuckle support platform 256 with knuckle cushion 258 mounted thereon.

Figure 11:
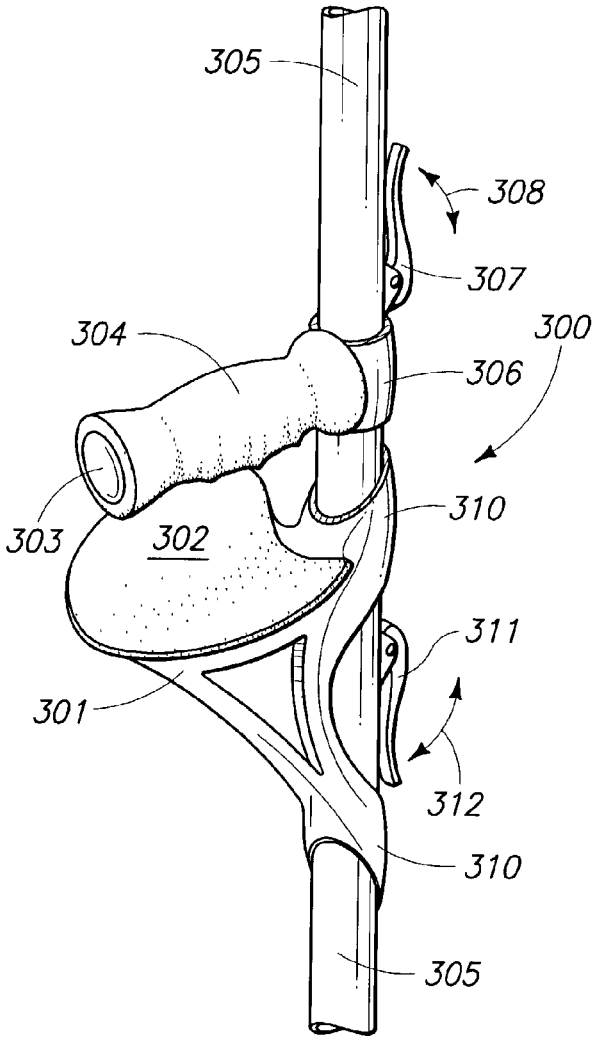
FIG. 11 is a perspective view of another embodiment of this invention which utilizes an adjustable knuckle support surface and an adjustable handle on the structure member or support.

FIG. 11 is a perspective view of another embodiment of this invention which shows knuckle support platform 301 mounted to structure member 305 via collars 310. The knuckle support platform 301 has a knuckle cushion 302 mounted onto the knuckle support surface thereof and is adjustably mounted to structure member 305 via a quick release lever 311 which moves generally in the direction of arrow 312.

Handle 303 includes handle cushion 304 and is mounted via collar 306 to structure member 305 via quick release mechanism 307 which moves generally in the direction of arrow 308.

FIG. 11 illustrates an embodiment of this invention which has different aesthetic qualities, and with a handle which does not move as in prior embodiments, but which is easily adjusted relative to knuckle support platform 301 via quick release lever 307, in for which the handle 303 is mounted in cantilever fashion to the structure member 305.

As will be appreciated by those of reasonable skill in the art, there are numerous embodiments to this invention, and variations of elements and components which may be used, all within the scope of this invention.

One embodiment of this invention, for example, is a body support apparatus comprising a structure member with a first end disposed to engage the ground; a knuckle support surface mounted to the structure member and disposed to receive and support a user's knuckles when the user's hand is closed; and a finger aperture defined be a finger retention surface and the knuckle support surface, the finger aperture configured to receive one or more fingers of a user while the knuckles of the closed hand of the user are engaged with the knuckle support surface. The finger aperture for instance may be defined by a flexible strap providing the finger retention surface, a glove or mitten mounted relative to the knuckle support surface, or it may be defined by a more rigid handle.

In the embodiment in which a handle is provided, the finger retention surface is a handle mounted to the structure member spaced apart from the knuckle support surface, such that area between the handle and the knuckle support surface define the finger aperture. In other and/or further embodiments, the handle may be movably mounted to the structure member, or fixedly mounted to the structure. If movably mounted, the handle may be movably mounted to the structure member to move in a combined vertical and horizontal direction or such that it pivots, among other ways, all within the contemplation of this invention.

There are also embodiments of the invention wherein the finger retention surface is a handle, and the handle is movably mounted relative to the knuckle support surface. It is not necessary that the handle be movably mounted relative to a support structure, but merely that it be movably mounted relative to the knuckle support surface, so either or both may move to produce the relative movement.

In embodiments of this invention, the support surface may be a flexible or a cushioned surface.

This invention also contemplates possible orientations of the handle in a number of different ways and/or directions, such as wherein the handle is oriented approximately parallel to a direction of movement of a user. However, it may also be at an approximate forty-five degree angle, or any other angle for that matter, all within the scope of this invention.

Embodiments of this invention may also include such items as a forearm attachment configured to attach to a user's forearm when a user's knuckles are engaging the knuckle support surface.

There are also crutch embodiments of this invention, for instance a crutch comprising: a structure member with a first end disposed to engage the ground; a handle mounted to the structural member and configured to be engaged by a human hand; and a knuckle support surface mounted to the structure member below and relative to the handle so as to form a finger aperture between the knuckle support surface and the handle. As in other embodiments, the crutch embodiment may include a handle which is movably mounted to the structure member in numerous different ways and configurations, such as to move in a vertical direction, a combined vertical and horizontal direction, or even to pivot.

As will be appreciated by those of ordinary skill in the art, the knuckle support surface may be mounted in any one of number of different locations and/or mount points, such as vertically above the structure member, or others.

In other embodiments contemplated by this invention, a body support apparatus may be provided which comprises: a structure means with a first end disposed to engage the ground; a knuckle support means mounted to the structure means and disposed to receive and support a user's knuckles when the user's hand is partially or wholly closed; and a hand engagement means to receive one or more fingers of a user while the knuckles of a closed hand of the user are engaged with the knuckle support means.

In another embodiment of the invention, a hand based weight distribution system is provided as a partial or total support for the body weight of the user, through knuckles on a user's hand. This system embodiment includes a support structure and a knuckle support surface mounted to the support structure, the knuckle support surface being disposed to receive and support knuckles of user. In this embodiment, the support structure may include a first end disposed to engage the ground, or the support structure may be mounted to a second structure, such as a ski to be used for handicap skiing, bicycle handlebars for a partial body support. It will be appreciated by one of ordinary skill in the art that this invention in many of its embodiments, may be used to support part or all of the user's body weight, depending on the specific application of the invention. Another example of a second structure to which the support structure may be mounted, is a wheelchair, the knuckle support surface to be used as a platform from which the user may place his or her knuckles to lift, move or reposition the body. For example, in FIG. 7, instead of the first end of the support structure 209 being disposed to engage the ground, it could be mounted to a ski or to a wheelchair, all within the contemplation of the invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A cane comprising:

an elongated structure member with a first end disposed to engage a ground surface;

a handle and a knuckle support platform mounted to the structure member proximate a second end at an approximate height to receive a hand of a user when standing, wherein the knuckle support platform is vertically below the handle, and wherein the handle and the knuckle support platform are biased away from one another, and wherein the knuckle support platform and handle configured to collectively receive and support weight of the user.

2. A cane as recited in claim 1, and further wherein the handle is movably mounted to the elongate structure member.

3. A cane as recited in claim 1, and further wherein the handle is fixedly mounted to the structure member.

4. A cane as recited in claim 1, and further wherein the knuckle support platform includes a flexible surface.

5. A cane as recited in claim 1, and further wherein the knuckle support platform is a knuckle support, and further comprising a knuckle cushion mounted on the knuckle support.

6. A cane as recited in claim 1, and further wherein the handle is oriented approximately parallel to a direction of movement of the user.

7. A cane as recited in claim 1, wherein the handle extends along a length and wherein the elongate structure member extends along another length and wherein the another length of the elongate structure member is at least about three times the length of the handle.

8. The cane as recited in claim 1, wherein downward pressure on the handle by the user's hand overcomes the bias to engage the user's hand with the knuckle support platform.

9. A body support apparatus comprising:

a structure member extending along a length between first and second opposing ends with the first end disposed to engage the ground;

a handle mounted proximate to the second end of the structure member, and;

a knuckle support platform mounted proximate to the second end of the structure member and extending along a long axis that is orthogonal to the length of the structure member, wherein the knuckle support platform defines a pair of knuckle support surfaces that when viewed transverse the long axis of the knuckle support platform approximate a portion of a v-shape for receiving knuckles of a user gripping the handle.

10. A body support apparatus as recited in claim 9, and further wherein the handle is movably mounted to the structure member.

11. A body support apparatus as recited in claim 9, and further wherein the handle is fixedly mounted to the structure member.

12. A body support apparatus, comprising:

a structure member extending along a length between a lower end to an upper end;

a handle for gripping by a user, wherein the handle is mounted to, and extends away from, the structure member proximate the upper end; and, a knuckle support platform mounted to the structure member proximate the handle, and wherein the handle and the knuckle support platform are biased away from one another.

13. The body support apparatus of claim 12, wherein a majority of the length lies between the lower end and the knuckle support platform.

14. The body support apparatus of claim 13, wherein the majority of the length is approximately equal to a length of the user's leg.

15. A body support apparatus, comprising:

a structure member extending from a first ground engaging lower end to a second upper end;

a handle for gripping by a user, wherein the handle is mounted to, and extends away from, the structure member proximate the second end; and, a knuckle support structure mounted to the structure member below, and extending generally parallel to, the handle, wherein the knuckle support structure defines an upper knuckle support surface that, when viewed generally transverse the handle, defines an angle for engaging a user's fist when the user grips the handle, wherein at least one of the handle and the knuckle support platform structure is moveable relative to the other of the handle and the knuckle support platform.

16. The body support apparatus of claim 15, further comprising an armpit attachment or a forearm attachment mounted to the second upper end and wherein the armpit attachment or the forearm attachment, the handle and the knuckle support apparatus are configured to collectively support body weight of the user.

17. A crutch comprising:

an elongated structure member extending along a length between a first end disposed to engage a surface of the ground and an opposing second end configured to receive one of an armpit attachment or a forearm attachment; and, a handle mounted to a knuckle support platform mounted to the elongate structure member between the first and second ends in a manner which allows vertical movement between the handle and the knuckle support platform, wherein the knuckle support platform and the handle are configured to receive and support weight of a user.

18. The crutch as recited in claim 17, wherein the handle is movably mounted to the knuckle support platform member to allow the vertical movement.

19. The crutch as recited in claim 17, and further wherein the knuckle support platform defines a knuckle support surface that faces the handle and wherein the knuckle support surface is flexible.

20. The crutch as recited in claim 17, wherein the elongated structure member comprises an upper support and wherein the forearm clamp is attached to the upper support.

* * * * *